United States Patent [19]

Sheffer

[11] Patent Number: 4,632,251

[45] Date of Patent: Dec. 30, 1986

[54] STORAGE CUBE

[75] Inventor: Phil B. Sheffer, New Oxford, Pa.

[73] Assignee: Merchandising Innovations, Inc., Hanover, Pa.

[21] Appl. No.: 813,547

[22] Filed: Dec. 26, 1985

[51] Int. Cl.[4] ..... B65D 5/48; B65D 5/14

[52] U.S. Cl. ..... 206/577; 206/44 R; 229/23 R; 229/27; 220/416

[58] Field of Search ..... 206/44 R, 45.19, 416, 206/441, 577; 229/15, 27, 23 R; 220/416, 441

[56] References Cited

U.S. PATENT DOCUMENTS

| | | | |
|---|---|---|---|
| 2,551,164 | 5/1951 | Ringler | 229/23 R |
| 2,726,803 | 12/1955 | Ketler | 229/23 R |
| 3,606,969 | 9/1971 | Voytko | 229/23 R |
| 3,861,579 | 1/1975 | Maris et al. | 220/416 |
| 4,463,997 | 8/1984 | Densen | 229/23 R |
| 4,574,996 | 3/1986 | Brian | 229/27 |

FOREIGN PATENT DOCUMENTS

| | | | |
|---|---|---|---|
| 1575372 | 9/1980 | United Kingdom | 229/15 |

*Primary Examiner*—William Price
*Assistant Examiner*—Brenda J. Ehrhardt
*Attorney, Agent, or Firm*—Daniel J. O'Connor

[57] ABSTRACT

The invention comprises a storage cube kit made of corrugated fiberboard and which may be shipped and sold in a flat or knockdown position to reduce shipping and handling costs.

The storage cube kit, while easy to assemble, results in a highly durable and attractive open shelf storage unit for home or office use.

The unique factory pre-cut design allows a display shelf and a backing plate to be securely held in place and to stabilize the entire unit so that multiple storage cubes may be stacked upon each other in a high load-bearing fashion.

5 Claims, 2 Drawing Figures

STORAGE CUBE

Papers relating to the present invention were previously filed under the Disclosure Document program of the U.S. Patent Office.

BACKGROUND AND OBJECTS OF THE INVENTION

This invention relates generally to storage cubes or modules useful for home or office use to contain books or other items.

The storage cube has been specifically designed by the inventor for use with a corrugated fiberboard student desk on which a related U.S. Patent Application has been filed. However, the storage cube has been realized to have utility in and of itself.

It is known that there is a high sales demand for durable and attractive stackable storage cubes. Metal storage devices currently on the market are typically relatively expensive due to metal materials cost and the high shipping costs of heavier articles occupying a large shipping volume.

Accordingly, it is an object of the present invention to provide a storage cube kit made of light-weight, yet durable materials wherein the parts may be shipped in a flat position to reduce shipping volume.

It is a further object of the present invention to provide a storage cube which may be easily and quickly assembled by the purchaser.

It is a further object of the present invention to provide a storage cube having a unique design for trapping or locking a shelf or divider therein.

Further objects and advantages of the present invention will become apparent as the following description proceeds, and the features of novelty characterizing the invention will be pointed out with particularity in the claims annexed to and forming a part of this specification.

PRIOR ART PATENTS

The use of knockdown corrugated materials for various display uses is known in the prior art as illustrated by the following patents: U.S. Pat. No. 4,279,375 issued to Gardner and U.S. Pat. No. 4,374,560 issued to Howlett.

As indicated by the above patents, systems have heretofore required relatively complex assembly techniques in the utilization of corrugated fiberboard material. Thus, while the material itself is easy to manipulate, the lengthy assembly required has resulted in less than the full market potential for corrugated fiberboard articles.

The prior art also indicates that corrugated fiberboard articles have not been of sufficient loadbearing capabilities, thus resulting in a lower market acceptance for the products involved.

As will be appreciated by those of skill in the art, the present invention effectively solves the above and associated problems. The unique engineering design of the factory pre-cut kit results in a highly stable and attractive end product for the consumer.

BRIEF SUMMARY OF THE INVENTION

The invention comprises a kit containing three corrugated fiberboard components which may be quickly assembled into a durable and attractive storage cube.

The unique design of a main body portion allows a shelf or divider to be fitted therein and securely locked in place by means of a trap pad and cooperating elongated and short tabs formed as a part of the main body protion.

BRIEF DESCRIPTION OF THE DRAWING FIGURES

FULL DESCRIPTION OF THE PREFERRED EMBODIMENT

Figure 1:
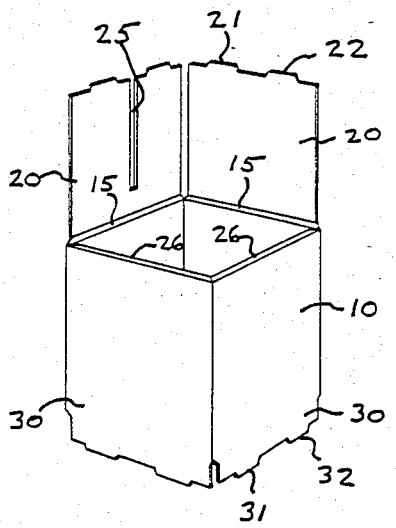
FIG. 1 shows an isometric view of the main body portion of the storage cube with two of the elongated flaps in a folded over position inside the main body.

Referring now to FIG. 1, it is seen that the main body portion 10 of the storage cube is a four-sided article comprised of corrugated fiberboard. It is to be understood that body 10 has been factory glued so that it may be shipped flat and easily expanded to its four-sided shape by the user.

Shown at the top of the main body 10 are elongated flaps 20 having tabs 21 and 22 formed as a part thereof. In practice, two opposing elongated flaps 20 have long slots 25 precut therein. In FIG. 1, two of the elongated flaps 20 are shown in the folded in position with only the outer edges 26 thereof being visible.

To begin assembly of the device, all four elongated flaps 20 are folded into the main body portion 10 via the pre-scored lines 15.

Also shown in FIG. 1 are short flaps 30 having tabs 31 and 32 formed as a part thereof.

Figure 2:
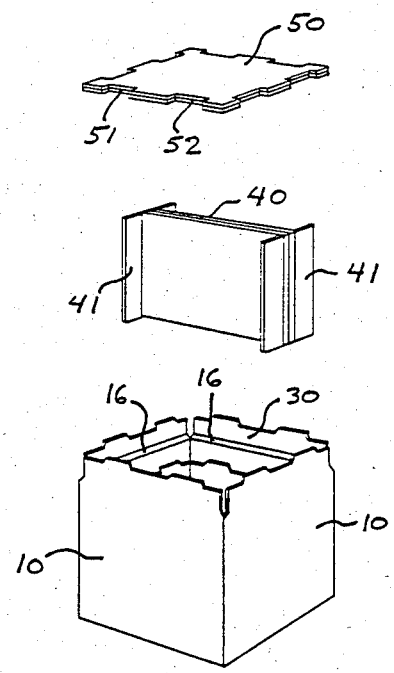
FIG. 2 shows an exploded isometric view of the three kit components to illustrate assembly of the device. All elongated flaps are in the folded over position internal to the main body portion.

Referring now to FIG. 2, in which the elongated flaps 20 have all been folded in and in which the main body 10 has been turned 180 degrees from FIG. 1, shelf or divider 40 having flaps 41 thereon is slid into the main body 10 so that it is retained by slots 25. The flaps 41 are thus held between the folded in slotted walls 20 and the inner walls of the main body 10.

Next a trap pad 50, being factory die cut, is dropped into the main body 10 so that it catches on the tabs of the long flaps 20. Thus, recessed portions 51 and 52 cooperate with tabs 21 and 22 of the long flaps 20.

In the final assembly step, the short flaps 30 are folded in via score lines 16 and serve to firmly secure the trap pad 50 in its desired position to thus retain the shelf or divider 40 solidly within the overall unit.

The resulting storage cube may be utilized as an insert component for a student desk as mentioned, or by itslef or in a multiple stacking array to provide a highly durable yet easily arranged storage system.

While corrugated fiberboard is the preferred material of the present invention, it will be appreciated that the inventive concepts disclosed herein could readily be applied using a wide range of currently available materials.

While there has been illustrated and described what is at present considered to be a preferred embodiment of the presention invention, it will be appreciated that numerous changes and modifications are likely to occur to those skilled in the art, and it is intended in the appended claims to cover all those changes and modifications which fall within the true spirit and scope of the present invention.

I claim:

1. A storage cube assembly kit comprising:

a main body portion (10) having first and second ends formed as a part thereof, wherein said first end of said main body portion (10) has a plurality of elongated flap means (20) formed thereon, said flap means being foldable to an inner region of said main body portion (10) by means of factory pre-cut score lines (15), wherein the flap means (20) on the first end of said main body portion have tab means (21,22) formed thereon and wherein at least one of said flap means (20) has elongated open slot means (25) formed therein, wherein said second end of said main body portion (10) has a plurality of shortened flap means (30) formed thereon, said shortened flap means (30) being foldable to an inner region of said main body portion (10) by means of factory pre-cut score lines (16), wherein said shortened flap means (30) have tab means (31,32) formed thereon, said shortened flap means (30) being solid and devoid of any slot means, said storage cube assembly kit further including a divider means (40) having flap means (41) formed thereon, wherein said divider means (40) and said flap means (41) are sized so as to fit between said elongated open slot means (25) formed on said first end flap means (20) and the inner region of said main body portion (10) upon folding of said first end flap means (20) into the inner region of said main body portion, said storage cube assembly kit further including a trap pad means (50) having recessed portion means (51, 52) formed thereon, said recessed portion means (51, 52) being sized to cooperatively interfit with said tab means (21, 22) formed on the flap means (20) on the first end of said main body portion (10), and means wherein, upon assembly, the tab means (31, 32) formed on said shortened flap means (30) act to securely retain said trap pad means (50) in its desired position of interfitting relation with said tab means (21, 22) formed on the flap means (20) on the first end of said main body portion (10).

2. The storage cube assembly kit of claim 1 wherein said main body portion (10) comprises a corrugated fiberboard material of square or rectangular cross-section and wherein said main body portion (10) is collapsible into a flat or knockdown position.

3. The storage cube assembly kit of claim 1 wherein said flap means (20) on the first end of said main body portion comprise four elongated flaps with at least two of said flaps having said open slot means (25) formed therein.

4. The storage cube assembly kit of claim 1 wherein each of said elongated flap means (20) and each of said shortened flap means (30) has at least two tab elements (21, 22, 31, 32) formed thereon.

5. The storage cube assembly kit of claim 1 wherein said score lines (15, 16) are formed to provide means wherein relatively thick outer edges (26) are formed upon inner folding of said flap means (20, 30).

* * * * *